United States Patent [19]

Burgoon

[11] 3,964,925

[45] June 22, 1976

[54] APPARATUS FOR TREATING FLOOR COVERINGS

[75] Inventor: Jack L. Burgoon, Toledo, Ohio

[73] Assignee: The Scott & Fetzer Company, Lakewood, Ohio

[22] Filed: July 1, 1974

[21] Appl. No.: 484,804

Related U.S. Application Data

[63] Continuation-in-part of Ser. No. 465,233, April 29, 1974, abandoned.

[52] U.S. Cl. ..... 134/21; 15/321; 15/322; 15/346; 134/37

[51] Int. Cl.[2] ..... B08B 5/04

[58] Field of Search ..... 15/320, 321, 322, 345, 15/346; 134/21, 37, 30

[56] References Cited

UNITED STATES PATENTS

| | | | |
|---|---|---|---|
| 2,270,579 | 1/1942 | Chamberlin | 15/346 X |
| 2,986,764 | 6/1961 | Krammes | 15/345 X |
| 3,079,285 | 2/1963 | Rockwell | 15/321 X |
| 3,101,505 | 8/1963 | Belicka et al. | 15/320 |
| 3,774,262 | 11/1973 | Anthony et al. | 15/345 X |

*Primary Examiner*—Peter Feldman
*Assistant Examiner*—C. K. Moore
*Attorney, Agent, or Firm*—Allen D. Gutchess, Jr.

[57] ABSTRACT

Apparatus for cleaning carpets is provided. The apparatus includes a nozzle for applying liquid such as water to the carpet and also includes air nozzles or openings for drying the carpet. Specifically, a vacuum nozzle is employed to pull in air and water from the carpet, with a hose connecting the vacuum nozzle to a vacuum tank which is associated with a vacuum blower. An exhaust air nozzle or opening is positioned near the vacuum nozzle, with a hose connecting this nozzle to an exhaust outlet associated with the vacuum blower. The vacuum nozzle and the exhaust air nozzle or opening are positioned so that warm exhaust air from the vacuum blower is emitted from the exhaust air nozzle or opening, passes at least partly through the carpet, and is at least partly returned with water through the vacuum nozzle to the tank. In one form, the exhaust air nozzle or opening can be opened and closed remotely through suitable linkages. The liquid nozzle is located in a plenum chamber associated with the exhaust air nozzle or opening and is directed toward the carpet through an exhaust air opening in the chamber. A valve controls flow of liquid to the liquid nozzle and in one form this valve is controlled by the same linkages that control the position of the exhaust air nozzle. When the exhaust air nozzle is closed, the valve is opened to supply liquid to the liquid nozzle with the exhaust air in the plenum chamber then passing through the exhaust air opening around the liquid nozzle and breaking up the liquid emanating therefrom into a spray. A rotatable brush can also be located below the liquid nozzle to receive liquid therefrom and also to receive the exhaust air which can help to cause rotation of the brush. The liquid for the nozzle can be supplied by gravity from a tank thereabove. The liquid tank can also be located remotely at the vacuum unit with the liquid supplied to the nozzle by means of the pressure of the exhaust air. In a simplified form, the exhaust air nozzle can be eliminated with the exhaust air passing through the exhaust air opening around the liquid nozzle at all times.

32 Claims, 14 Drawing Figures

202
204
206
208
210
212
214
216
218
220
222
224
226
228
230
232
234
236
238
240
242
244
246
248
250
252
254
256
260
262
264
266
268
270
272
274
276
278
280
282
284
286
288
290
292
294
296
298
300
302
304
306
308
310
312
314
316
318
320
322
324
326
328
330
332
12

APPARATUS FOR TREATING FLOOR COVERINGS

This application is a continuation-in-part of my copending application Ser. No. 465,233, filed on Apr. 29, 1974, and now abandoned.

This invention relates to apparatus for treating floor coverings and more specifically to a carpet cleaning machine.

For a long period of time until recently, emphasis in carpet cleaning was on the use of "dry" foams which were applied to the carpet, worked into it, and then mostly left in the carpet without being extracted. More emphasis is now being placed on the extraction of foam or other cleaning material applied to the carpet.

The present invention relates to a carpet cleaning machine of the latter type wherein cleaning liquid and dirt are removed from the carpet, and the carpet is dried. The new carpet cleaning machine includes a vacuum nozzle positioned to pull air, dirt, and water up from the carpet, with a flexible hose connecting the vacuum nozzle and a vacuum tank. The machine also has an exhaust air nozzle or opening positioned near the vacuum nozzle and connected by a flexible hose to an exhaust outlet of a vacuum blower communicating with the vacuum tank. Through this arrangement, the warm exhaust air from the blower is directed toward the carpet near the vacuum nozzle so as to be drawn through the carpet and back through the vacuum nozzle. In this manner, the exhaust air is put to work and provides a benefit in aiding in drying the carpet, particularly since this air is warmed to some extent by the work done on it by the vacuum blower. Typically, this air can be at a temperature of 90° to 100°F.

A liquid nozzle is positioned in a plenum chamber above the exhaust air nozzle and is directed through an exhaust air opening toward the carpet. The liquid nozzle can be opened and closed and, in one form, the exhaust air nozzle can be closed or opened through suitable linkages controlled by the operator. The exhaust air can be supplied through the exhaust air opening around the liquid nozzle toward the carpet to break up the liquid into a spray so as to be better distributed over the carpet. The exhaust air nozzle also can be eliminated and the exhaust air supplied continually through the exhaust air opening around the liquid nozzle, with the latter still controlled in an on-off manner, as before. In one modification, the air exhausted downwardly through the liquid nozzle opening also can be directed toward a rotatable brush positioned therebelow so as to supply the liquid over the brush whereby it can be better worked into the carpet and also to aid in rotating the brush. Thus, even additional work can be extracted from the exhaust air. The liquid supplied to the liquid nozzle can be located in a tank on the machine above the nozzle and supplied by gravity. Alternately, the liquid supply tank can be located remotely from the machine at the vacuum unit and in communication with the exhaust air of the unit. The liquid is then supplied to the liquid nozzle by means of the pressure of the exhaust air, which thereby performs an additional function.

It is therefore, a principal object of the invention to provide an improved carpet cleaning machine utilizing a vacuum and exhaust air to aid in drying the carpet.

Another object of the invention is to provide a machine for treating floor coverings in which a vacuum is employed and in which a benefit is extracted from exhaust air from the vacuum forming means.

A further object of the invention is to provide a carpet machine having a vacuum nozzle and having an exhaust air nozzle or opening with a liquid nozzle for directing the liquid toward the carpet, with the exhaust air aiding in breaking up the liquid into a spray.

Yet another object of the invention is to provide a carpet cleaning machine having a rotatable brush and a vacuum nozzle with exhaust air from the vacuum source directed toward the brush to aid in rotating the same.

Still a further object of the invention is to use pressure of the exhaust air in a vacuum system for supplying liquid to a nozzle of a floor machine.

Other objects and advantages of the invention will be apparent from the following detailed description of preferred embodiments thereof, reference being made to the accompanying drawings, in which.

Figure 1:
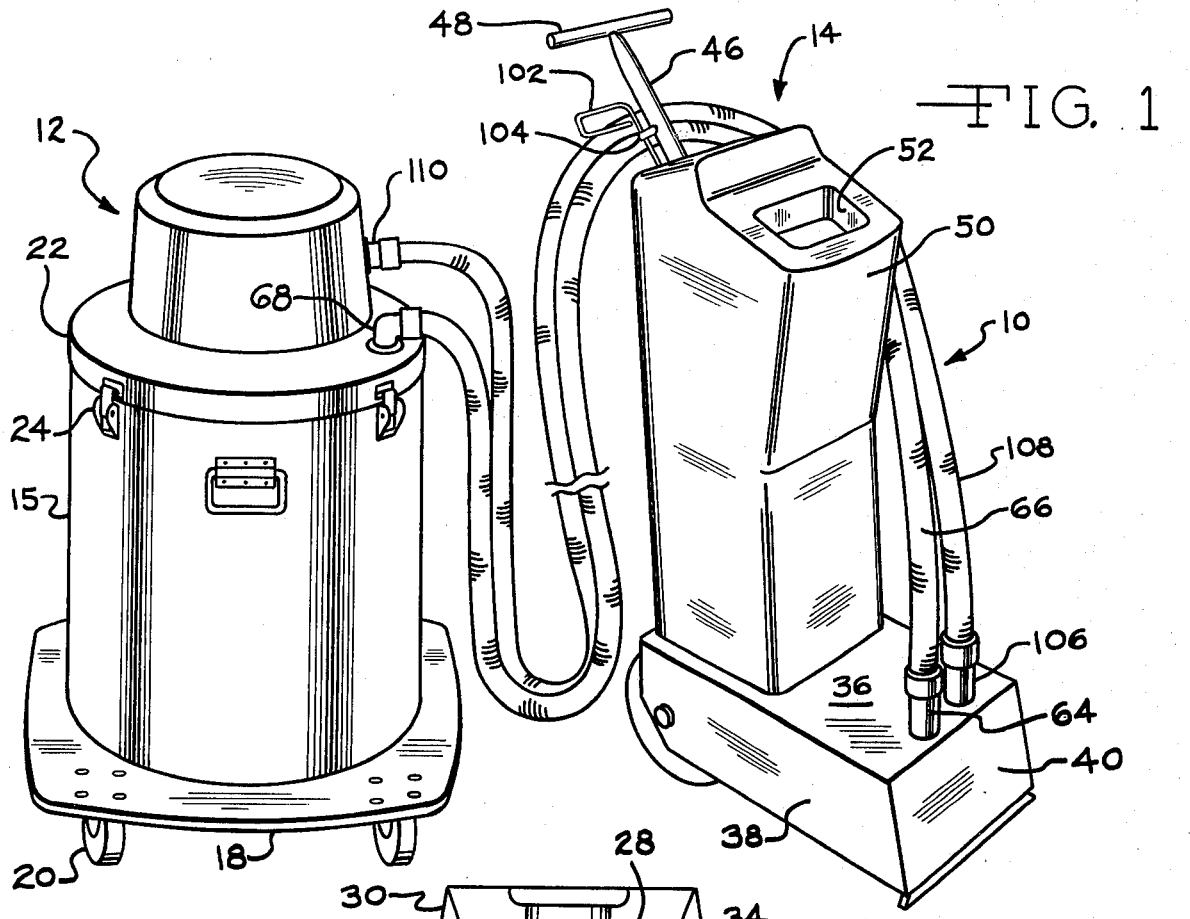
FIG. 1 is an overall view in perspective of floor treating apparatus according to the invention, including a floor-treating machine and a vacuum source.
Figure 2:
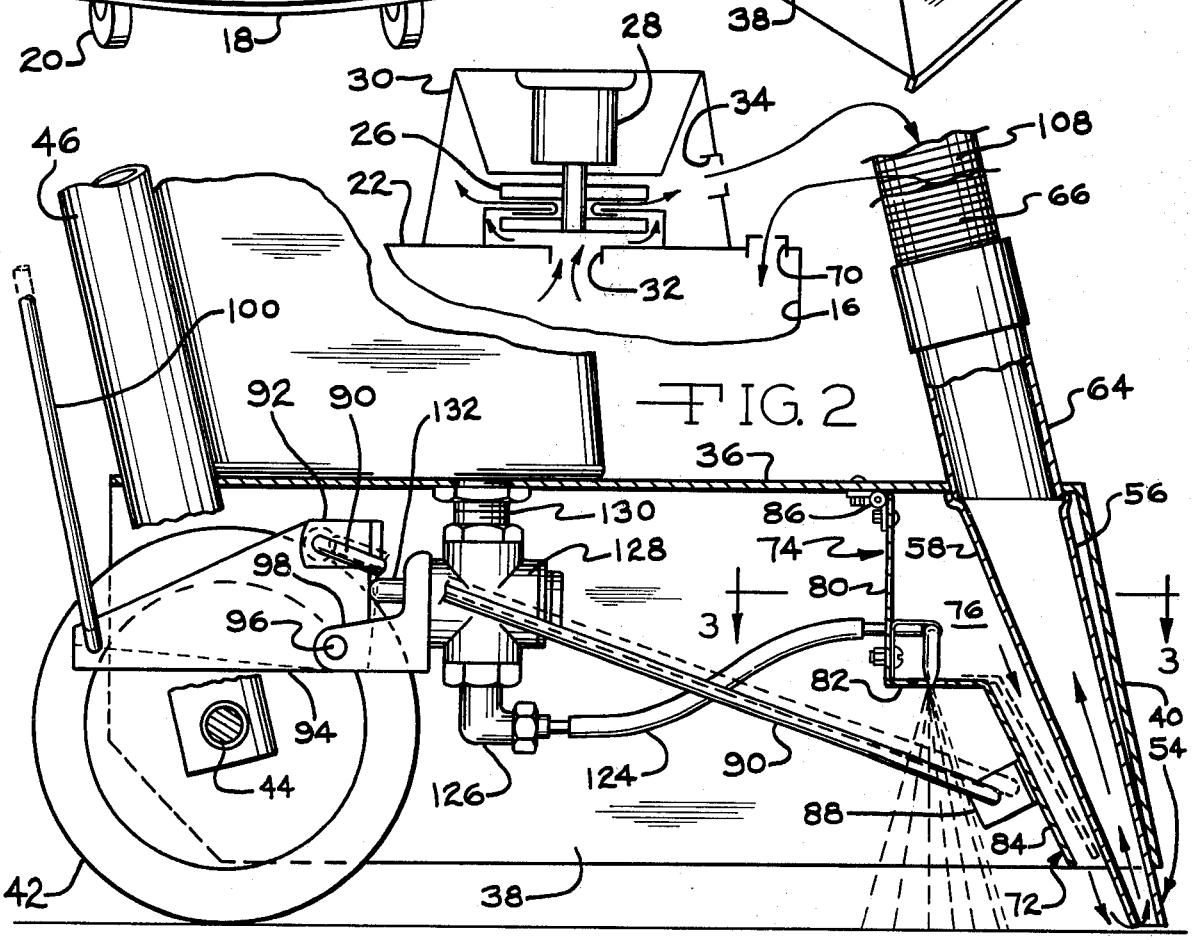
FIG. 2 is a fragmentary view in longitudinal cross section of the machine of FIG. 1 and schematically showing part of the vacuum source.

Referring particularly to FIGS. 1 and 2, apparatus for treating floor coverings is indicated at 10 and basically includes a vacuum unit or source 12 and a cleaning, rinsing, and drying unit or machine 14. The vacuum unit 12 includes a vacuum tank 15 forming a vacuum chamber 16 mounted on a platform 18 having casters 20. The tank 15 has a lid 22 held thereon by over-center clamps 24. A vacuum blower 26 is located above the lid 22 and is driven by a motor 28 suspended in a housing 30. The blower 26 pulls air from the tank 15 through a central opening 32 and exhausts the air through an exhaust opening 34 in the housing 30. Heretofore, the exhausted air has simply been dissipated.

The unit 14 includes a horizontal supporting platform or frame 36 having side skirts 38 and a front skirt 40. Pairs of rear wheels 42 are located between the side skirts 38 and are rotatably mounted on a shaft 44. An operating post 46 has its lower end rotatably mounted on the axle 44 and extends upwardly to a handle (FIG. 1). A liquid supply tank 50 is mounted on the platform 36 and can also be affixed to the post 46, if desired. The tank 50 has a filling opening 52 designed so that the unit 14 can be tilted back and rested on the handle 48 without liquid in the tank 50 spilling out the opening 52.

Figure 4:
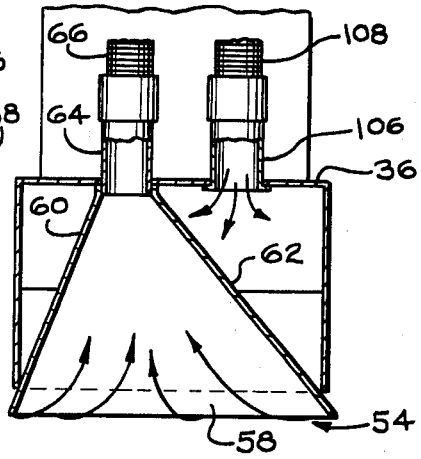
FIG. 4 is a view in generally vertical cross section taken through the forward part of the machine of FIG. 2.
Figure 3:
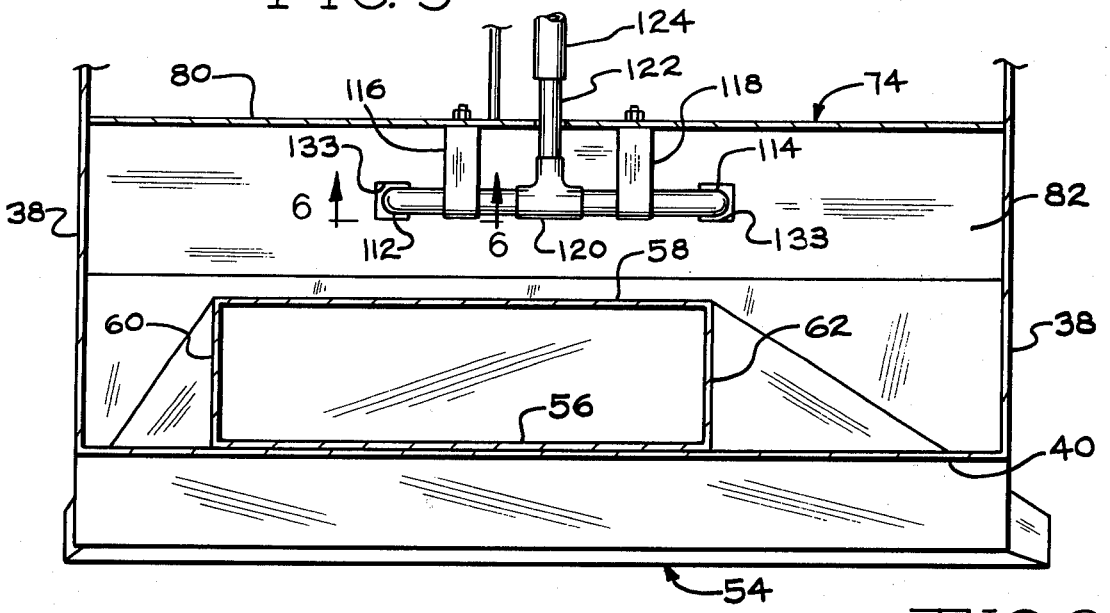
FIG. 3 is an enlarged view in horizontal cross section taken along the line 3—3 of FIG. 2.

A vacuum nozzle 54 is located at the front of the unit 14, adjacent the forward skirt 40, and is formed by front and rear, generally triangularly-shaped walls 56 and 58 and end walls 60 and 62 (FIG. 4). A nipple 64 is affixed to the upper ends of the walls 56–62 and is connected to a suitable flexible hose 66 which connects with an L-shaped fitting 68 at inlet opening 70 in the tank lid 22. Air and air-borne water or other particles pulled up through the vacuum nozzle 54 are transmitted under relatively high velocity into the opening 70 at which time the air velocity substantially decreases in the volume chamber 16 so that the air-borne particles drop out and only air is pulled through the opening 32 by the vacuum blower 26.

In accordance with the invention, an exhaust air nozzle or opening 72 is located near the vacuum nozzle 54 so that at least some of the air emanating from the nozzle 72 can pass through the floor covering being treated and back through the vacuum nozzle 54, as shown by the arrows in FIG. 2. The nozzle 72 is formed in part by the rear wall 58 of the vacuum nozzle 54 and by a movable rear wall 74 which forms a plenum chamber 76 above the nozzle 72, along with side walls which are parts of the side skirts 38, part of the front skirt 40, and part of the platform 36. The rear wall 74 has an upper generally vertical portion 80, a generally horizontal or stepped portion 82, and a lower, slanted portion 84. The entire rear wall 74 is supported from the platform 36 by a hinge 86 so that the wall, and particularly the lower slanted portion 84 thereof, can pivot about the hinge so as to move from an open position as shown in full lines in FIG. 2 to a closed position as shown in dotted lines. In the latter instance, the lower edge of the slanted wall portion 84 is moved against the rear wall 58 of the nozzle 54 to close the exhaust air nozzle or opening 72. Thus, the exhaust air nozzle 72 can be controlled by the movement of the rear wall 74.

To more the wall 74, an ear 88 is affixed to the lower slanted portion 84 and is connected by a rod or link 90 to an ear 92 of a pivot plate 94 pivotally mounted by a pin 96 on a bracket 98. An operating rod 100 is pivotally connected to a rear portion of the plate 94 and extends upwardly to a handle 102 (FIG. 1) slidably carried in a bracket 104 affixed to the post 46. When the handle 102 is pulled upwardly, the plate 94 moves in a clockwise direction around the pin 96, as viewed in FIG. 2, and moves the ear 92 and the rod 90 forwardly to shut the exhaust air nozzle 72. Exhaust air is supplied to the plenum chamber 76 above the nozzle 72 through a nipple 106 (FIG. 4) affixed to a forward portion of the platform 36 and communicating with the chamber. The nipple is connected by a flexible hose 108 to a fitting 110 (FIG. 1) communicating with the exhaust air outlet 34 (FIG. 2) in the housing 30 adjacent the vacuum blower 26. With this arrangement, the exhaust air from the blower 26 is supplied through the hose 108 and out the nozzle 72. This air is heated to a temperature of 90°–100°F. so as to aid in the drying of the floor covering when the air passes out the nozzle 72, flows through the floor covering, and is pulled back into the vacuum nozzle 74.

Figure 5:
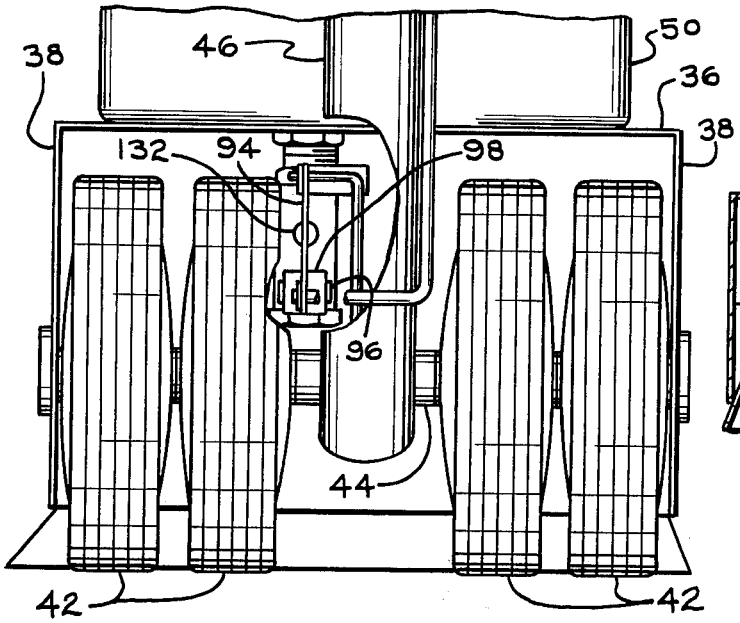
FIG. 5 is a rear view, with parts broken away, of the machine.
Figure 6:
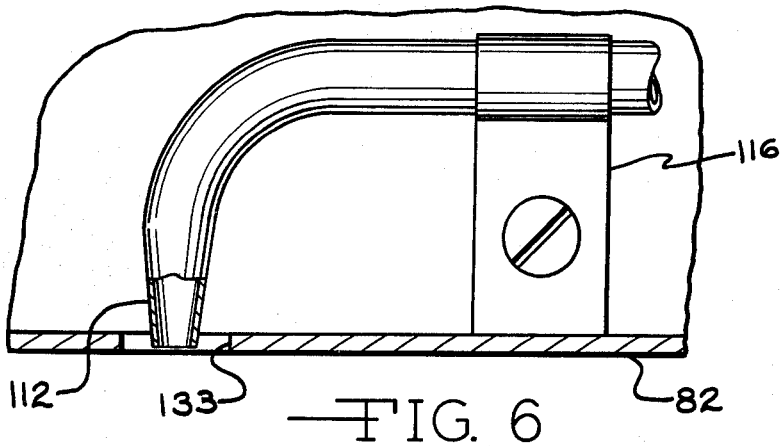
FIG. 6 is an enlarged sectional view taken along the line 6—6 of FIG. 3.

A pair of liquid nozzles 112 and 114 (FIGS. 5 and 6) are located above the stepped portion 82 of the rear wall 74, being suitably supported by brackets 116 and 118 which are affixed to the vertical wall portion 80. The nozzles 112 and 114 are connected through a tee 120 to a supply nipple 122 connected to a flexible line 124. The line 124 in turn is connected to a fitting 126 (FIG. 2) which communicates with a valve 128. The valve 128 is connected through a nipple 130 with the tank 50. The valve 128 has a spring-loaded button 132 which, when pushed in, opens the valve 128. When the plate 94 is moved in the clockwise direction, it contacts the button 132 and pushes it in, opening the valve 128 and enabling liquid to flow by gravity through the valve 128 to the nozzles 112 and 114. The connecting plate 94 is supported by the bracket 98 which in turn is affixed to the body of the valve 128 so that the proper relationship is maintained between the plate 94 and the valve button 132.

The liquid in the tank 50 supplied to the nozzles 112 and 114 preferably is either plain water or water and a detergent, but in either case it is hot. If the carpet or floor covering has been cleaned previously with foam, particularly several times, then water alone may be sufficient to provide cleaning of the carpet and to enable the previously-deposited foam to be removed. If there is little or no foam in the carpet, then detergent or the like can be used with water to provide additional cleaning beyond that obtained by the hot water alone.

With the above arrangement, when the handle 102 is pulled upwardly, the plate 94 moves clockwise to open the valve 128 and at the same time shut the exhaust air nozzle 72. The exhaust air then flowing through the nipple 106 into the plenum chamber 76 is exhausted toward the floor covering through exhaust air openings or nozzles 113 in the stepped portion 82 of the rear wall 74. This air breaks up the liquid flowing through the nozzles 112 and 114 into sprays, as shown in FIG. 2, so that the liquid is more uniformly distributed over the carpet or other floor coverings.

When the unit 14 is pushed forwardly by an operator, he can pull upwardly on the handle 102 to move the rod 100 upwardly to shut the exhaust air nozzle 72 and supply liquid through the nozzles 112 and 114, thereby thoroughly wetting the carpet therebelow. When the unit 14 is pulled rearwardly by the operator, he can release the handle 102 to shut the valve 128 and open the exhaust air nozzle 72. During the rearward movement the warmed exhaust air passes downwardly through the wetted carpet and upwardly through the vacuum nozzle 54. The air and air-borne water and dirt thereby flow upwardly through the flexible hose 66 and into the tank chamber 16 where the water and dirt drop out. The air then enters the blower 26 through the inlet 32 and is exhausted through the outlet 34 back through the hose 108 to the nozzle 72 again, being warmed in the process. One rearward pass of the unit 14 will remove most of the liquid in the carpet, with a second pass substantially removing the rest, thereby leaving the carpet just damp. In most instances, one pass is considered sufficient. Above all, there is substantially no foam left in the carpet.

The unit 14 can also be operated in a single rearward pass. With the unit pulled rearwardly, the liquid is sprayed onto the floor covering and is then picked up by the vacuum nozzle. The unit is then tilted back on the forward stroke so that the vacuum nozzle 54 clears the floor covering and the unit is moved to another area for the next rearward stroke.

Figure 7:
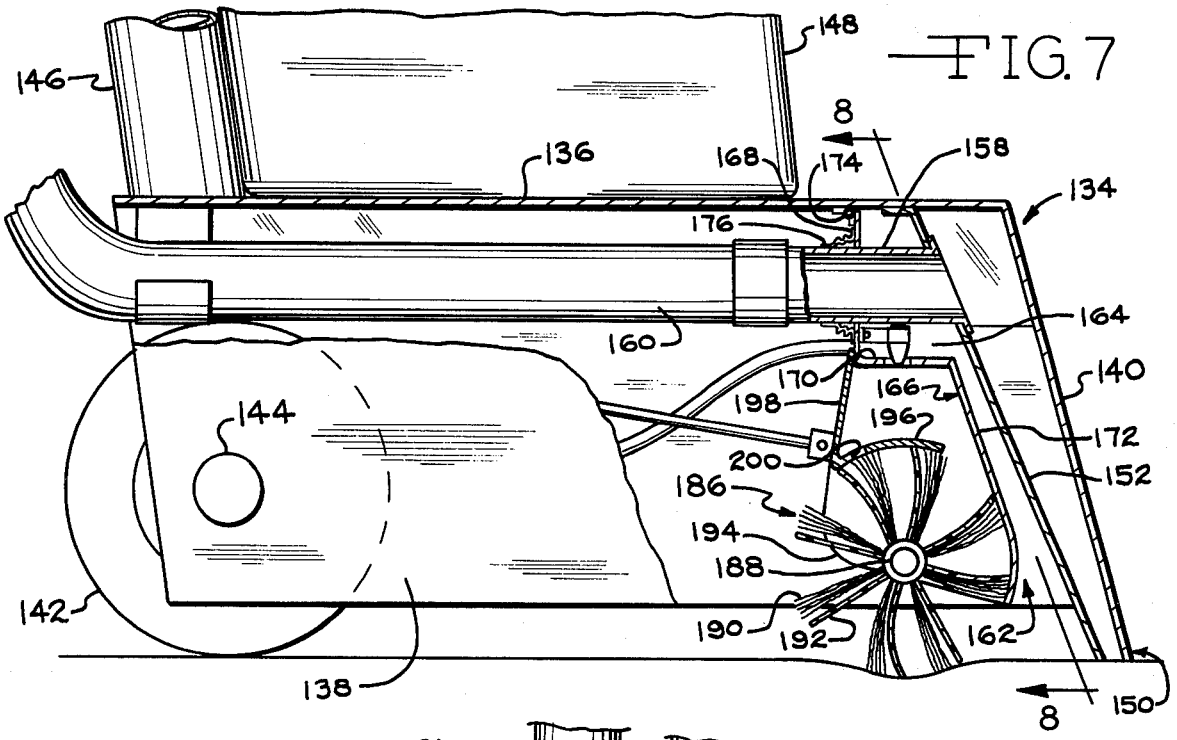
FIG. 7 is a side view in elevation, with parts broken away and with parts in section, of a modified floor-treating machine.
Figure 8:
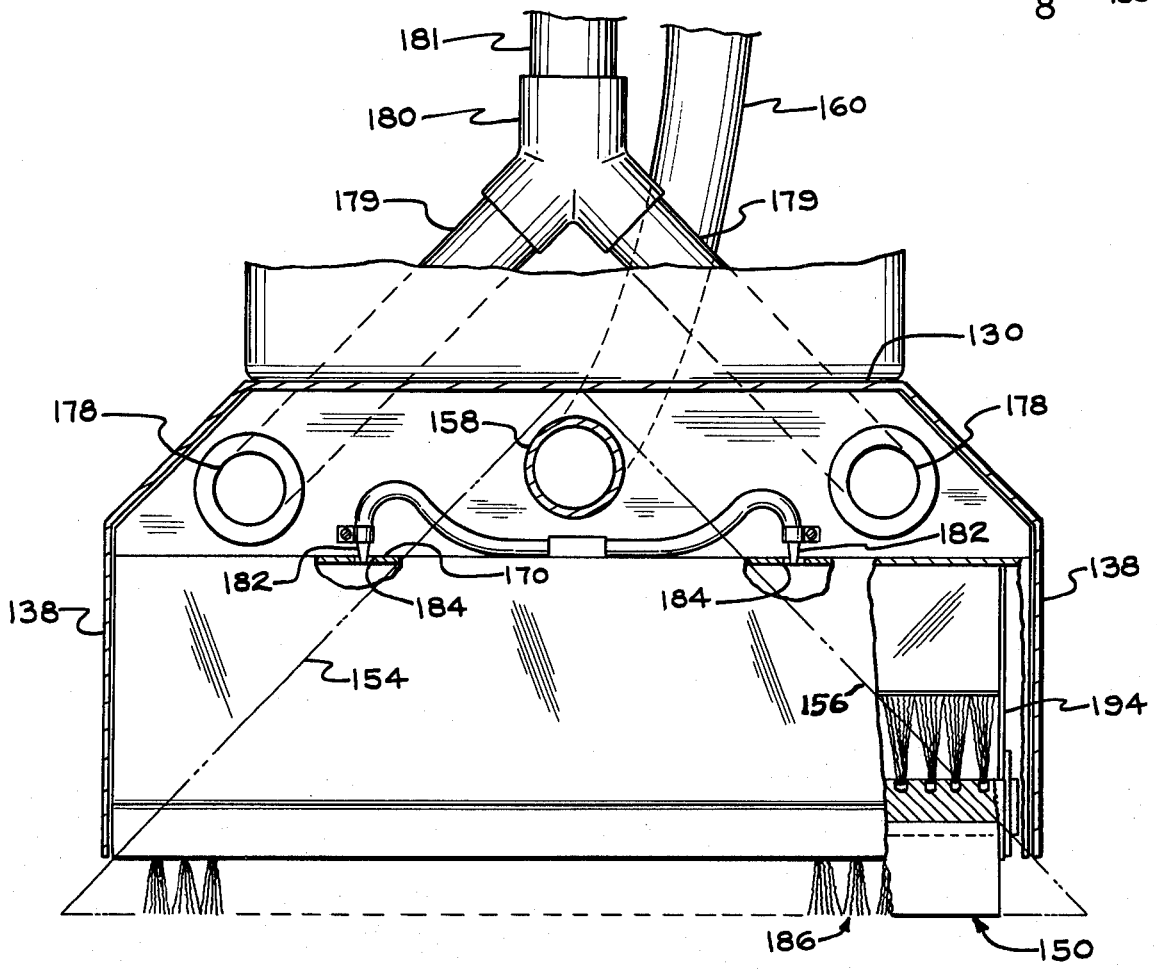
FIG. 8 is a view in section, with parts broken away, taken along the line 8—8 of FIG. 7.

Referring to FIGS. 7 and 8, a modified cleaning, rinsing, and drying unit or machine is indicated at 134. The unit 134 includes a platform 136, side skirts 138, and a front skirt 140. Rear wheels 142 are mounted on an axle 144 with a post 146 in this instance affixed to the platform 136 rather than connected to the axle 144. A tank 148 is located on the platform 136 and can be similar to the tank 50. A vacuum nozzle 150 is formed by the front wall 140, a rear wall 152 and side walls 154 and 156. In this instance, a nipple 158 is affixed to the rear wall 152 and has a flexible hose 160 extending rearwardly under the platform 136 and back to a vacuum fitting of the vacuum unit, which can be the same as the unit 12. This rearwardly-extending arrangement for the flexible hose produces less obstructions for the operator and also presents a cleaner, more attractive appearance for the machine.

An exhaust air nozzle or opening 162 is located behind the vacuum nozzle 150. The nozzle 162 and a plenum chamber 164 thereabove are formed by the rear wall 152 of the nozzle 150 and a movable rear wall indicated at 166, along with portions of the side skirts 138. The rear wall 166 includes a generally vertically-extending portion 168, a stepped or horizontal portion 170, and a slanted lower portion 172. The rear wall 166 is hinged to the platform 154 by a hinge 174 to enable the rear wall 166 to pivot and more the exhaust air nozzle 162 between an open position, as shown, and a closed position, in which the lower portion of the slanted wall portions 172 contacts the wall 152 of the nozzle 150. The vacuum nipple 158 extends through a diaphragm or gasket 176 mounted on the vertical portion 168 of the rear wall 166 to prevent leakage therearound.

Exhaust air nipples 178 communicate with the chamber 164 and are connected to hoses 179. These connect to a fitting 180 of a flexible hose 181 which communicates with an exhaust air fitting of the vacuum unit.

Liquid nozzles 182 correspond to the liquid nozzles 112 and 114 and are supplied with liquid from the tank 148 in the same manner as with the unit 14. When the air exhaust nozzle 162 is shut, air in the plenum chamber 164 flows toward the carpeting through exhaust air openings or nozzles 184 around the liquid nozzles 182 to break up the liquid into sprays. When the exhaust air nozzle 162 is open, as shown, most of the air exhausts downwardly toward the carpeting and is picked up through the vacuum nozzle 150. The liquid nozzles are shut off at this time.

In this instance, a rotatable brush indicated at 186 is located below the nozzles 182 and the openings 184. The brush includes a central axle 188 having a plurality of bristle tufts 190 extending therefrom and with a flexible strip 192 located adjacent each of the bristle tufts. The axle 188 is rotatably carried by side walls 194 which are affixed at the slanted wall portion 172 and the stepped portion 170 of the rear wall 166. An arcuate wall 196 and a back wall 198 extend between the side walls 194, the arcuate wall 196 forming a partial housing, with the lower portion of the slanted wall portion 172, for the brush 186. The arcuate wall 196 directs the spray of liquid from the nozzles 182 downwardly and toward the forward portion of the bristle tufts 190. The water is thereby spread uniformly over the bristles and the air exhausting downwardly through the openings 184 pushes against the flexible strips 192. This air pressure tends to help rotate the brush 186 as well as break up the liquid from the nozzles. Liquid collected on the rear portion of the arcuate wall 196 can drain through openings 200.

The brush further helps in cleaning the floor covering more effectively, enabling the liquid to penetrate it to a greater extent than otherwise. The brush 186 will move clockwise, as shown in FIG. 7, when the unit 134 is moved forwardly, at which time liquid is supplied to the nozzles 182 and the exhaust air mozzle 162 is shut. When the unit is moved rearwardly, the nozzle 162 is opened with the exhaust air then flowing through the floor covering and back through the vacuum nozzle 150.

Rather than employing the solution or liquid tank on the cleaning, rinsing, and drying unit, it can be incorporated into the vacuum unit, thereby making the cleaning, rinsing, and drying unit lighter, smaller, and easier to manipulate.

Figure 10:
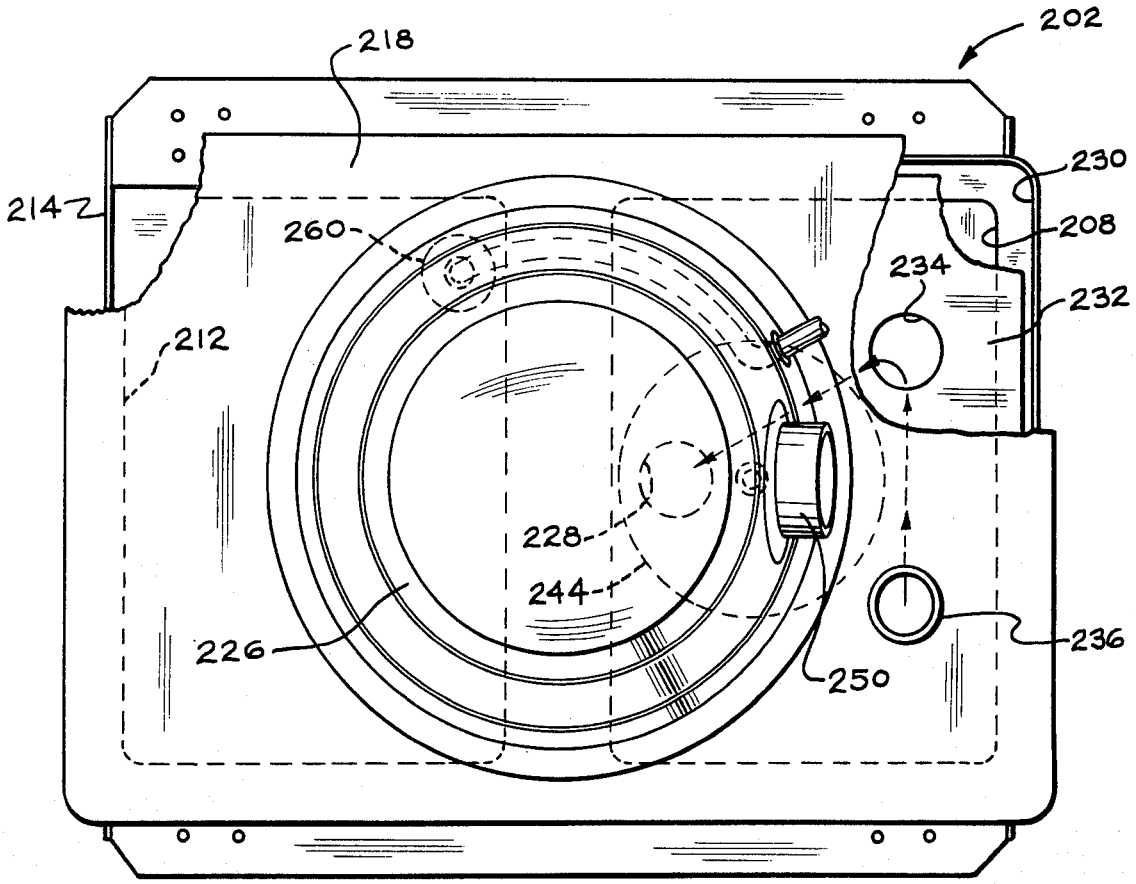
FIG. 10 is a top view, with parts broken away, of the vacuum source of the apparatus of FIG. 9.

Referring to FIGS. 9–12, a modified vacuum unit is indicated at 202 and a modified cleaning, rinsing, and drying unit or machine is indicated at 204. The vacuum unit 202 includes a vacuum tank 206 forming a vacuum chamber 208 and a pressure tank 210 forming a pressure chamber 212. The two tanks 206 and 210 are supported on a tray 214 having casters 216, the tray 214 having a suitable handle (not shown) by means of which the vacuum unit can be moved from room to room, as desired. The tanks 206 and 210 are separate so that they can be individually emptied or filled. A common lid 218 covers both of the tanks 206 and 210, sealing them by a foam layer 220 under the lid. A vacuum blower 222 is positioned centrally above the lid and is driven by a vacuum motor 224 suspended in a housing 226. The blower 222 pulls air from the vacuum chamber 208 through an inlet opening which communicates directly with an upper vacuum chamber 230 separated from the chamber 208 by a baffle 232, communicating therewith through an opening 234 (FIG. 10). A vacuum inlet tube 236 extends through the lid 218 and through an opening 238 into the chamber 208. When the blower 222 is operating, air is drawn through the inlet 236 into the tank 206 where air-borne water droplets and other particles drop out of the air as it loses its velocity. The air is then pulled back through the opening 234 and through the lid opening 228 into the vacuum blower 222.

A float 240 is located in the chamber 208 and has a central connecting rod 242 extending upwardly through the baffle 232 to a valve disc 244. In the event that the solution and suds pulled into the tank 206 becomes excessive, the float 240 moves upwardly and causes the valve disc 244 to close off the opening 228, thereby substantially eliminating the vacuum in the chamber 208 so that no further liquid will be drawn through the inlet 236. Except for the float valve and the baffle, the tank 206 functions similarly to the tank 15 of the vacuum unit 12.

The air from the blower 222 is discharged into an annular plenum chamber 246 and exhausted through an exhaust outlet 248 having a fitting 250 thereon. The air under pressure in the plenum chamber 246 also communicates with the pressure chamber 212 through an opening 252 in the lid 218, an upper chamber 254, and an opening 256 in a baffle 258. A liquid such as a cleaning solution is supplied to the tank 212 with this tank replacing the liquid tank 50 of the unit 14. The pressure in the chamber 212 then forces the liquid through an inlet filter 260 and through a tube 262 which extends out of the unit 202 to a suitable connector 264.

The cleaning, rinsing, and drying unit 204 includes a platform or frame 266 having side skirts 268 with a pair of rear wheels 270 located at the rear of the platform. A vacuum nozzle 272 is located at the front of the unit and is formed by front and rear, generally triangularly-shaped walls 274 and 276, and end walls 278. A fitting 280 is located at the upper end of the walls and is connected to a rigid upwardly-extending tube 282. A flexible hose 284 connects the upper end of the tube 282 to the vacuum inlet 236 of the unit 202. Air and air-borne water or other particles are pulled up through the vacuum nozzle 272 and travel at high velocity through the tube 282 and the hose 284 into the chamber 208, at which time the air velocity decreases and the particles drop out.

An exhaust air nozzle or opening 286 is located near the vacuum nozzle 272 so that air from the nozzle 286 can pass through the floor covering and back through the nozzle 272, as before. The nozzle 286 is formed similarly to the nozzle 72 of FIG. 2. It includes a rear wall 288 which forms a plenum chamber 290 above the nozzle 286, with the chamber also being formed in part by the rear nozzle wall 276, the platform 266, and side skirts 268. The rear wall 288 is supported from the platform 266 by a hinge 292 so that the rear wall can pivot to move from an open position, as shown in solid lines, to a closed position, as before. To move the rear wall, a bar 294 extends rearwardly from the wall 288 and has an opening 296 receiving an enlargement 298 adjustably mounted on the end of an operating rod 300. This rod is pivotally connected to a hand lever 302 which in turn, is pivotally supported on a bracket 304. When the lever 302 is raised, it lowers the rod 300 to push on the bar 294 and move the rear wall 288 from the open to the closed position.

Air is supplied to the plenum chamber 290 through a long rigid tube 306 which extends upwardly and then curves to a horizontal portion 308 which also constitutes an operating handle for the unit 204. A flexible hose 310 is connected to the tube and extends to the exhaust air fitting 250 of the unit 202. The exhaust air from the blower 222 is supplied through the hose 310 and the tube 306 to the nozzle 286. As before, this air is heated to a temperature of 90°–100°F. so as to aid in the drying of the floor covering when the air passes out of the nozzle and at least part flows through the floor covering and is pulled back into the vacuum nozzle 272.

Figures 9, 12:
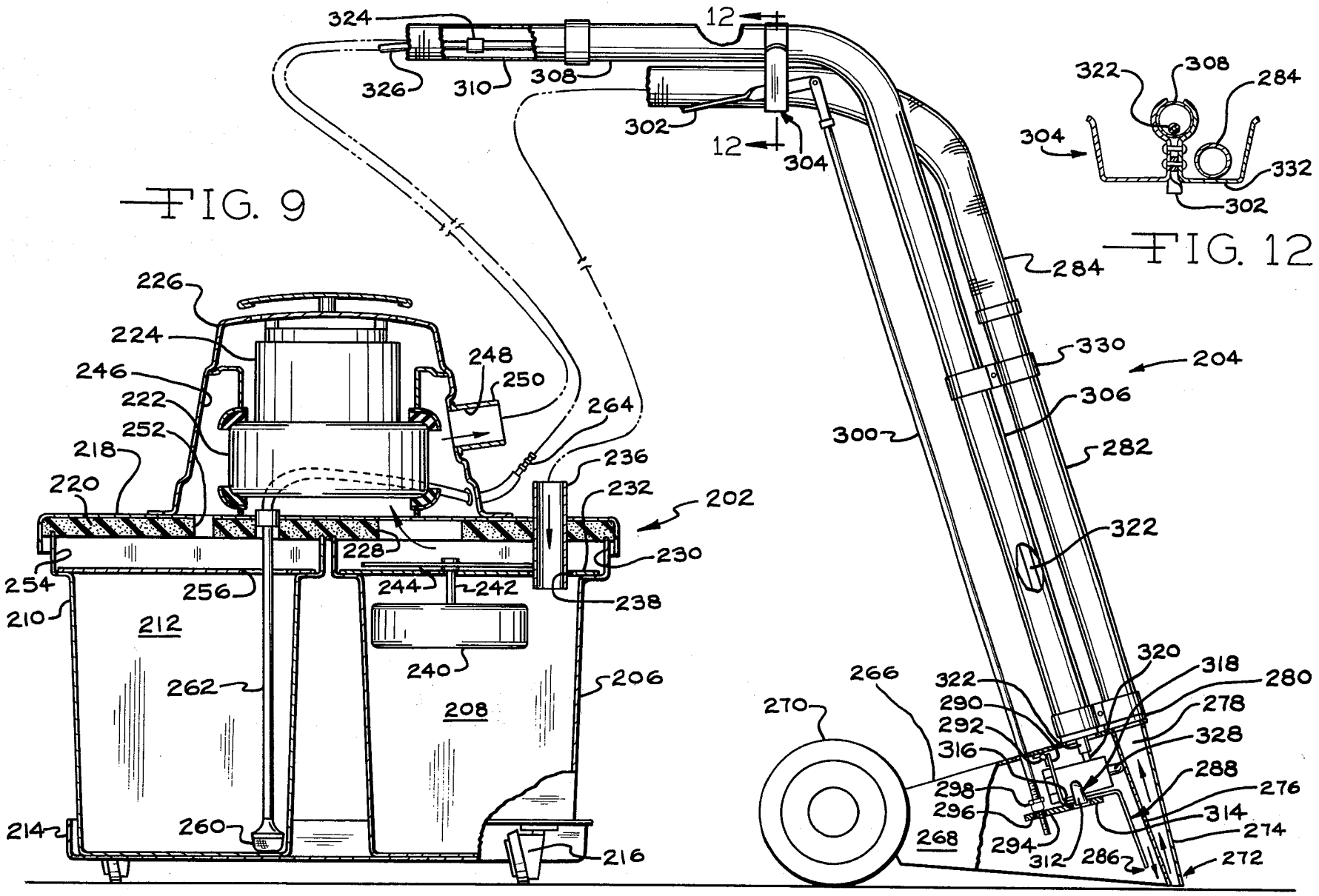
FIG. 9 is an overall view in elevation, with parts broken away and with parts in section, of modified floor-treating apparatus, including a machine and a vacuum source.
FIG. 12 is a detail view in transverse cross section, taken along the line 12—12 of FIG. 9.
Figure 11:
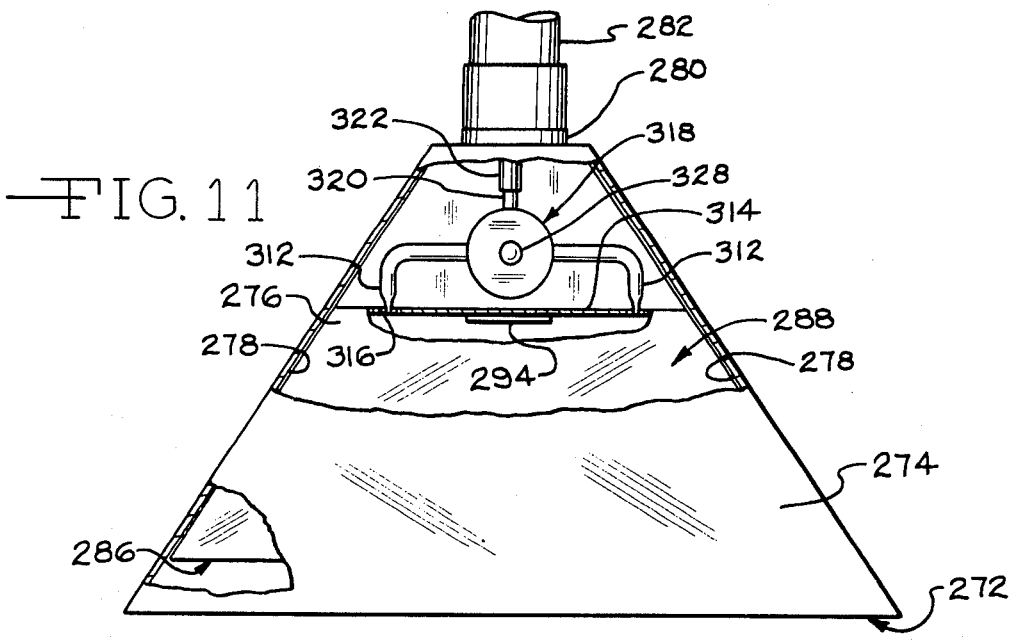
FIG. 11 is a front view of the machine of FIG. 9.

A pair of liquid nozzles 312 (FIG. 11) are located above an offset portion 314 of the rear wall 288 and are directed through exhaust air openings or nozzles 316 in the offset wall portion 314. In this instance, the nozzles 312 extend outwardly from the sides of a valve 318 mounted on the rear wall 288. The valve 318 has an upwardly-extending inlet nipple 320 which communicates with a small flexible liquid supply hose or tube 322. This small tube extends upwardly through the air tube 306 and beyond the portion 308 where it terminates in a suitable fitting 324 (FIG. 9). Another small flexible hose or tube 326 connected to the fitting 324 extends through the flexible air hose 310 to a point near the vacuum unit 202 where it branches outside and connects with the fitting 264 of the tube 262. The valve 318 has a spring-loaded button 328 which engages the rear nozzle wall 276 when the rear wall 288 is moved forwardly to the closed position. When so pushed in, the button 328 opens the valve 318 and enables liquid under pressure in the tank 210 to flow through the inlet filter 260, the tubes 262, 236, and 322, and to the nozzles 312. Since the exhaust nozzle 286 is now closed, the air in the plenum chamber 290 passes largely through the exhaust air openings 316 around the nozzles 312 toward the floor covering and help disperse the liquid into sprays as it exits from the nozzles.

The rigid air tubes 282 and 306 are connected together by brackets 330 with the bracket 304 also being mounted on the handle portion 308 of the tube 306. The bracket 304 has outwardly-extendng portions 332 (FIG. 12) either of which can receive and support the flexible hose 284 for the exhaust nozzle 272, if desired.

The operation of the unit 204 is similar to that of the unit 14 and will not be discussed in detail. The supply liquid, instead of being fed by gravity, is supplied under pressure by means of the exhaust air. Consequently, the exhaust air in this instance serves an additional function beyond helping dry the floor covering by passing from the exhaust air nozzle or opening to the vacuum nozzle.

Figure 13:
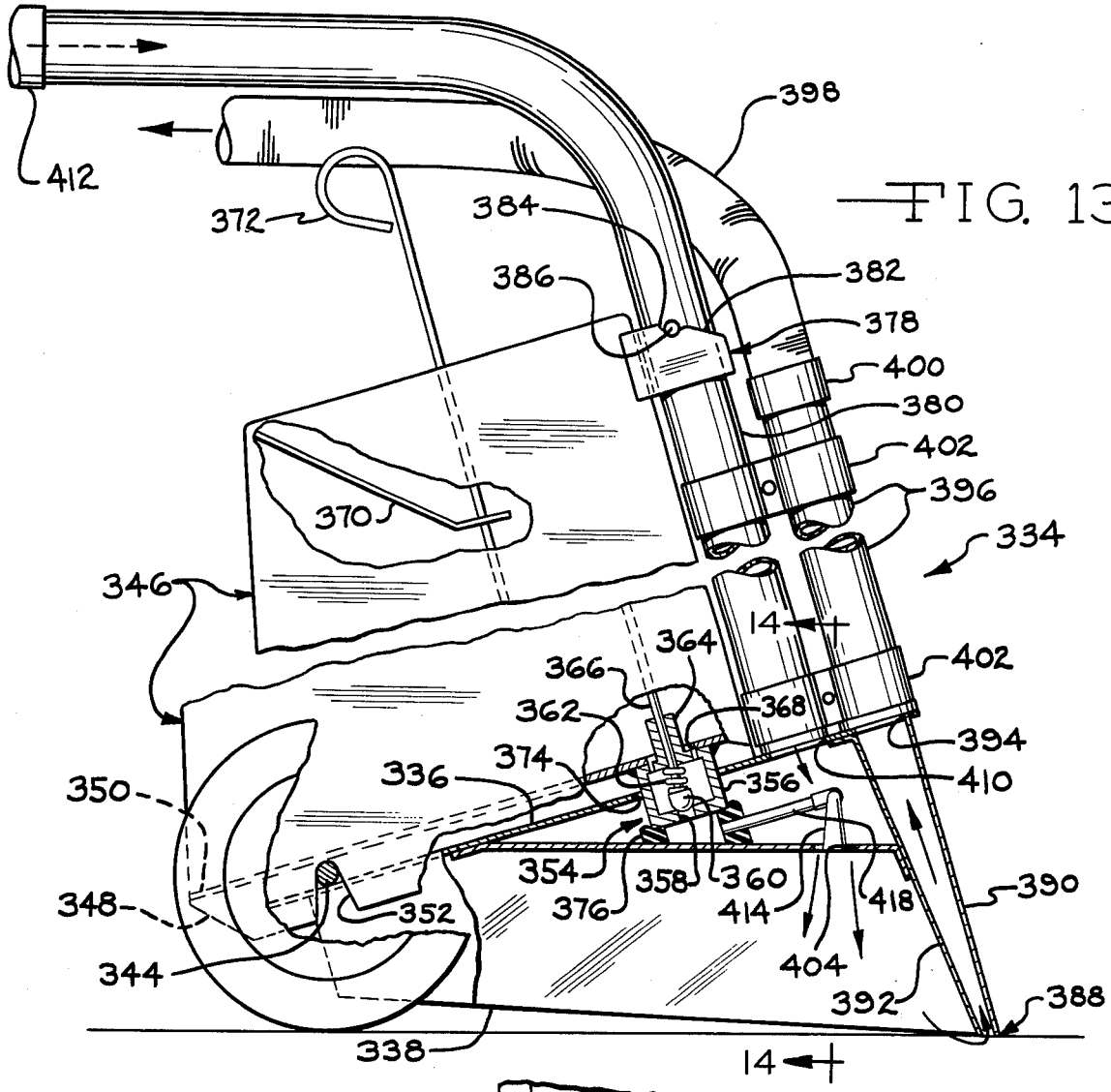
FIG. 13 is a fragmentary side view in elevation, with parts broken away and with parts in section, of a modified floor-treating machine.
Figure 14:
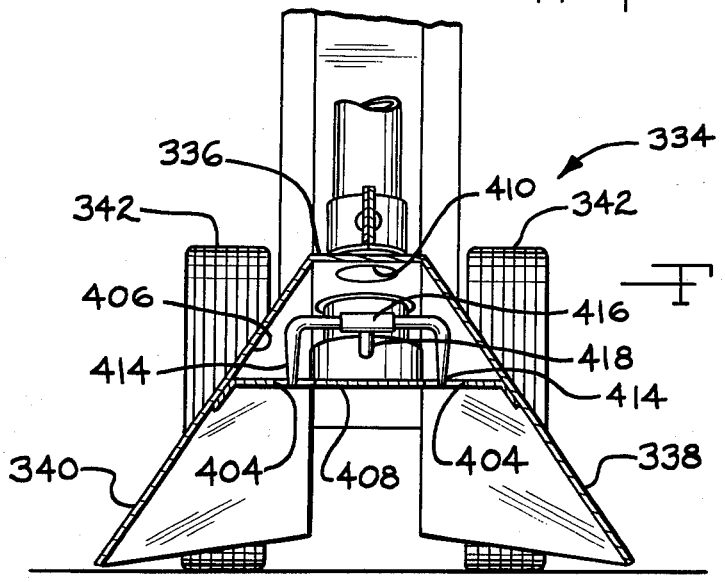
FIG. 14 is a vertical sectional view, taken along the line 14—14 of FIG. 13.

Referring to FIGS. 13 and 14, a modified cleaning, rinsing, and drying unit or machine is indicated at 334. The unit includes a narrow platform 336 and side skirts 338 and 340. Rear wheels 342 are mounted on an axle 344 which extends through rear portions of the side skirts 338 and 340, the wheels being located outside the skirts. The skirts are widely spaced apart at the front of the machine and converge to a much narrower spacing at the rear, between the wheels 342.

A tank 346 is located above the platform and has a suitable filling opening through the top thereof. In this instance, the tank has lower side wall extensions 348 which extend downwardly below a tank bottom 350 and have notches 352 which are received over the axle 344, between the side edges of the platform 336 and the wheels 342. The tank 346 is removable from the machine 334 and, consequently, carries its own valve 354 for controlling flow of liquid therefrom. The valve 354 includes a valve housing 356 which is suitably attached to the tank bottom 350 and forms a liquid outlet opening 358, at the upper end of which is a valve seat. A valve body 360 is urged against the valve seat by a spring 362 which is backed up by a valve rod guide 364 through which a valve rod 366 extends. The valve rod guide 364 is mounted adjacent a lower tank opening 368 but enables liquid to flow thrugh the opening around the guide. The guide rod 366 extends upwardly completely through the tank and through the filler opening, being supported near its upper end by a bracket 370. The valve 354 can be opened by pulling up on an upper valve handle 372, with the spring 362 urging the valve body 360 back against the valve seat when the handle is released.

The valve housing 356 extends through an opening 374 in the platform 336 when mounted on the machine and presses against a diagonally-cut heavy rubber ring or annular member 376. Near the upper end of the tank 346 are brackets 378 which extend on opposite sides of a long rigid tube 380. Each of the brackets 378 has a slanted cam edge 382 and a notch 384 which receives a pin 386 extending outwardly on either side of the tube 380.

With this arrangement, when the tank 346 is to be mounted on the unit 334, the tank is tilted back with the notches 352 aligned with and placed on the axle 344. The tank can then be swung forwardly with the cam edges 382 of the brackets 378 engaging the pins 386 and forcing the front of the tank downwardly so that the valve housing 356 engages and compresses the resilient ring 376. The tank is pushed farther forwardly until the pins 386 are engaged in the notches 384. The tank is held in this position by virtue of the compressive nature of the resilient ring 376 urging the forward portion of the tank upwardly to maintain the pins 386 in the notches 384.

A vacuum nozzle 388 is located at the front of the unit 334 and is formed by front and rear, generally triangularly-shaped walls 390 and 392, and forward portions of the side skirts 338 and 340. An opening 394 in a forward end of the platform 336 communicates with the nozzle and with a rigid upwardly-extending tube 396. A flexible hose 398 connects to the tube 396 through a fitting 400 with the flexible hose connected with a vacuum inlet of a vacuum unit or source which can be the same as the unit 12. The tube 396 can be supported by the main rigid tube 380 through brackets 402. If desired, the tube 396 can be of a transparent plastic material so that the air, air-borne liquid, and air-borne dirt pulled up through the nozzle 388 can be viewed by the operator and others to demonstrate the cleaning power of the unit 334.

In accordance with the invention, exhaust air openings or nozzles 404 are located near the vacuum nozzle 388 so that at least some of the air emanating from the nozzles 404 can pass through the floor covering being treated and back through the vacuum nozzle. A plenum chamber 406 is formed above the exhaust air openings 404 by a horizontal wall 408 in which the openings 404 are formed, along with an upper portion of the wall 392, upper portions of the side skirts 338 and 340, and a forward portion of the platform 336. An opening 410 in the platform 336 communicates with the plenum chamber 406 and with the long rigid tube 380 which bends rearwardly at its upper end to form an operating handle for the unit. A flexible hose 412 can connect the tube 380 with an exhaust air fitting of an exhaust air outlet of a vacuum source or unit such as the unit 12 of FIG. 1. Thus, exhaust air from the vacuum source heated to a temperature of 90°–100°F., for example, passes through the tube 380 and out the exhaust air openings 404. This air is directed downwardly through the floor covering and at least part is pulled through the vacuum nozzle 388. While it might be expected that a larger exhaust air nozzle or opening would be needed, actually, with two of the openings 404 being only three-eighths inch square, sufficient area is provided to enable a proper flow of exhaust air therethrough. This is due in part to the fact that although the vacuum nozzle has a larger area, it is actually restricted guite severely by its close cooperation with the floor covering.

A pair of liquid nozzles 414 are located adjacent the exhaust air openings 404 and can direct liquid therethrough. The nozzles 414 are connected by a tee 416 to a supply line 418 which extends through the resilient ring 376 to the interior thereof. With this arrangement, when the handle 372 is raised, the valve body 360 separates from the valve seat and enables liquid to flow from the tank 346 around the guide 364 and into the valve housing 356, through the opening 358, and into the interior of the resilient ring 376. From here the liquid flows through the line 418, through the tee 416, and through the liquid nozzles 414. The exhaust air flowing through the flexible hose 412, the rigid tube 380, and the plenum chamber 406, emanates from the exhaust air openings 404 and breaks up liquid from the nozzles 414 into sprays.

In the operation of the machine or unit 334, when the operator pulls the machine rearwardly, he raises the handle 372 to cause liquid to spray on the floor covering therebelow and wet it. As the vacuum nozzle 388 moves over the wetted area, it then picks up the exhaust air and air-borne water and dirt and carries them back to the vacuum source. At the end of the rearward stroke, the operator can then tilt the unit 334 slightly back on the wheels 342 to raise the nozzle 388 and move the machine up to another area of the floor covering for the next cleaning stroke. With the unit 334 or any of the previously-described units, a particularly soiled area can be spot cleaned by moving the unit over that area, tilting the machine to break the vacuum at the nozzle and directing the liquid spray toward the soiled area. The liquid can then be picked up by the vacuum nozzle after the area is sufficiently wetted.

In an alternate operation, as the unit 334 is pushed forwardly by the operator, he can raise the handle 372 to supply liquid through the nozzle 414, thereby wetting the floor covering or carpet therebelow. When the unit 334 is pulled rearwardly, the handle 372 is released to stop the flow of liquid, with the exhaust air emanating from the openings 404 then passing downwardly through the wetted carpet and up through the vacuum nozzle 388 along with the air-borne water and dirt. The machine is then manipulated to an adjacent area of floor covering and the process repeated. With this mode of operation, the lower edge of the vacuum nozzle must be smooth and broad enough to avoid digging into the floor covering.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. Apparatus for cleaning a floor covering or the like, said apparatus comprising means forming a vacuum nozzle, means forming an exhaust air opening near said vacuum nozzle, means for supporting said nozzle means and said opening means over the floor covering for movement thereover, a remote vacuum tank, a vacuum blower remote from said nozzle means, said opening means and said supporting means and communicating with said tank for establishing a vacuum in said tank, a housing around said vacuum blower and having an exhaust outlet, first flexible passage means connecting said vacuum nozzle and said tank to establish a continuous flow of air through said nozzle to said tank whenever said blower is operating, second flexible passage means connecting said exhaust air opening and said exhaust outlet, and a liquid nozzle positioned at said exhaust air opening for directing liquid toward the floor covering with the exhaust air passing through said exhaust air opening being effective to break up the liquid from said liquid nozzle.

2. Apparatus according to claim 1 characterized by the area of said exhaust air opening being variable.

3. Apparatus according to claim 1 characterized by means for controlling the flow of liquid to said liquid nozzle and for opening and closing said exhaust air opening.

4. Apparatus according to claim 3 characterized by said control means shutting off the liquid when opening said exhaust air opening.

5. Apparatus according to claim 1 characterized by a rotatable brush rotatably mounted below said liquid nozzle.

6. Apparatus according to claim 1 characterized by a source of liquid connected with said liquid nozzle, said liquid source being in communication with the exhaust air of said blower to place the liquid under pressure.

7. Apparatus according to claim 1 characterized by a container of liquid, means connecting said container of liquid and said liquid nozzle, and means connecting said container and said housing to place the liquid in the container under pressure by means of the exhaust air in said housing.

8. Apparatus according to claim 1 characterized by said exhaust air opening being a nozzle located immediately behind said vacuum nozzle.

9. Apparatus according to claim 8 characterized by said vacuum nozzle means and said exhaust air opening means having a common wall.

10. Apparatus according to claim 1 characterized by said second passage means further comprising a plenum chamber communicating with said exhaust air opening, with said liquid nozzle being in said plenum chamber to direct liquid toward the floor covering through said exhaust air opening.

11. Apparatus according to claim 1 characterized by said vacuum nozzle means and said exhaust air opening means being positioned so that at least some of the air exhausted from said opening contacts the floor covering and is then drawn into said vacuum nozzle.

12. Apparatus according to claim 1 characterized by said supporting means comprising a platform, a liquid container for containing liquid at ambient pressure, means for supplying liquid from said container to said liquid nozzle, and means for removably supporting said liquid container above said liquid nozzle on said platform.

13. Apparatus according to claim 12 characterized by said liquid container having means forming a valve in a lower portion thereof for controlling flow of liquid from said container to said liquid nozzle.

14. Apparatus according to claim 12 characterized by remotely-controlled means extending upwardly through said container for opening and closing said valve.

15. Apparatus for supplying liquid to and aiding in removing liquid from a floor covering or the like, said apparatus comprising means forming a vacuum nozzle, means forming an exhaust air opening near said vacuum nozzle, a vacuum tank remote from said nozzle forming means and said opening forming means, means for forming a vacuum and having an inlet communicating with said tank for establishing a vacuum therein and having an exhaust outlet, first passage means including a first flexible hose connecting said vacuum nozzle and said tank, second passage means including a second flexible hose connecting said exhaust air opening and the exhaust outlet of said vacuum means, and a liquid nozzle positioned to direct liquid through said exhaust air opening toward the floor covering whereby exhaust air passing through said exhaust air opening is effective to break up the liquid as it moves toward the floor covering.

16. Apparatus according to claim 5 characterized by means forming a liquid container in communication 15 the vacuum means exhaust to place the liquid under pressure.

17. Apparatus according to claim 15 characterized by said second passage means including a plenum chamber above said exhaust air opening with said liquid nozzle being in said plenum chamber and positioned so that the exhaust air flows past opposite sides of said nozzle, and means for supplying liquid to said liquid nozzle.

18. Apparatus according to claim 17 characterized by a housing said vacuum means including therearound and communicating with the exhaust outlet, said housing having an exhaust fitting, and said second passage means connecting said exhaust air opening with the exhaust fitting of said housing.

19. Apparatus according to claim 17 characterized by said liquid supply means comprises a liquid container located above said liquid nozzle, and passage means connecting said container and said liquid nozzle.

20. Apparatus according to claim 19 characterized by means for removably supporting said liquid container above said liquid nozzle, and means forming a valve in a lower portion of said container for controlling flow of liquid from said container through said passage means.

21. Apparatus according to claim 20 characterized by remotely-controlled means extending upwardly through said container for opening and closing said valve.

22. Apparatus according to claim 20 characterized by wheels for movably supporting said container, an axle for said wheels and a portion of said container being pivotally supported on said axle and removable therefrom.

23. Apparatus according to claim 17 characterized by means for opening and closing said exhaust air opening, and said liquid supply means comprises a valve which is open when said exhaust air opening is closed and is closed when said exhaust air opening is open.

24. Apparatus according to claim 17 characterized by means for opening and closing said exhaust air opening, a valve for controlling the supply of liquid to said liquid nozzle, and means for opening said valve when said exhaust air opening is closed and for closing said valve when said exhaust air opening is open.

25. Apparatus according to claim 17 characterized by means for opening and closing said exhaust air opening, a valve for said liquid supply means, and remote control means for opening said exhaust air opening and closing said liquid valve at substantially the same time and for closing said exhaust air opening and for opening said liquid valve at substantially the same time.

26. Apparatus according to claim 17 characterized by a flexible tube connecting said liquid nozzle with the liquid in the supply means, said flexible tube being smaller than said second passage means and extending partially through said second passage means between said liquid supply means and said air exhaust opening.

27. Apparatus according to claim 17 characterized by supporting means for said vacuum nozzle means and said opening, said liquid supply means comprises a liquid container, a valve attached to a lower portion of said liquid container and extending into said plenum chamber through an opening in said supporting means when said container is supported on said supporting means, and means in said plenum chamber communicating with an outlet of said valve and with said liquid nozzle for supplying liquid from said container to said liquid nozzle when said valve is open.

28. Apparatus according to claim 27 characterized by said last-named means comprising resilient means in communication with said valve and urging said valve in an upward direction out of said plenum chamber.

29. Apparatus according to claim 28 characterized by said liquid container having upper bracket means urged by said resilient means into cooperating relationship with cooperating means carried by said supporting means to hold said container in a fixed position relative to said supporting means.

30. Apparatus according to claim 15 characterized by supporting means for said vacuum nozzle means and said opening, an axle extending across said supporting means, wheels on opposite sides of said supporting means, a liquid container for supplying liquid to said liquid nozzle means, said container having means for removably engaging said axle to support said container above said liquid nozzle means, said container having additional means spaced above said axle for cooperating with at least one of said first and second passage means for retaining said container in a fixed position relative to said supporting means.

31. A method of cleaning a floor covering or the like comprising forming a vacuum zone at the floor covering by means of a remote vacuum blower communicating with the zone through a flexible passage and continuously drawing air through the floor covering and any liquid in the floor covering at the zone through the flexible passage back toward the vacuum blower, depositing any air-borne liquid in a tank adjacent the blower, returning the exhaust air from the blower through another flexible passage through an exhaust air opening to an area of the floor covering behind the zone, establishing a supply of liquid under atmospheric pressure above the zone and area, periodically supplying liquid from said supply through the exhaust air opening near said area and directing the liquid in spray form to the area with the exhaust air, and moving the zone and the area along with the exhaust air opening and the liquid supply over the floor covering while maintaining the blower and the tank substantially stationary.

32. A method according to claim 31 characterized by supplying the liquid through the exhaust air opening by means of a liquid nozzle and supplying the exhaust air to the opening on at least two opposite sides of said liquid nozzle.

* * * * *

UNITED STATES PATENT AND TRADEMARK OFFICE

CERTIFICATE OF CORRECTION

PATENT NO. : 3,964,925

DATED : June 22, 1976

INVENTOR(S) : Jack L. Burgoon

It is certified that error appears in the above-identified patent and that said Letters Patent are hereby corrected as shown below:

Column 3, line 46, change "more" to --move--.

Column 4, line 38, change "113" to --133--.

Column 5, line 30, change "more" to --move--.

Column 6, line 11, change "mozzle" to --nozzle--.

Column 9, line 57, change "guite" to --quite--.

Column 12, line 2, change "15" to --with--.
-line 13, delete "a housing" and after "including" insert --a housing--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*